United States Patent [19]

Viramontes-Brown et al.

[11] 4,412,858

[45] Nov. 1, 1983

[54] METHOD OF CONVERTING IRON ORE INTO MOLTEN IRON

[75] Inventors: Ricardo Viramontes-Brown, Garza Garcia; Jorge B. Castanon, San Nicolas de los Garza, both of Mexico

[73] Assignee: Hylsa, S.A., Monterrey, Mexico

[21] Appl. No.: 397,222

[22] Filed: Jul. 12, 1982

[51] Int. Cl.[3] ..... C21B 13/06

[52] U.S. Cl. ..... 75/38; 75/40

[58] Field of Search ..... 75/38, 5 BA, 11, 34, 75/35, 40

[56] References Cited

U.S. PATENT DOCUMENTS 2,919,983 1/1960 Halley ..... 75/38
3,963,483 6/1976 Mathesius et al. ..... 75/38
4,008,074 2/1977 Rossner et al. ..... 75/43
4,236,699 12/1980 Davis, Jr. ..... 75/33

*Primary Examiner*—M. J. Andrews

[57] ABSTRACT

Improved operation of the broadly known combination of a moving bed, gaseous reduction reactor for reducing iron ore and a melter-gasifier for converting to molten metal the sponge iron pellets produced in such a reactor is achieved by preparing a mixture of finely ground sponge iron and coal, either by mixing the sponge iron and coal and then grinding or by separately grinding the sponge iron and coal and then mixing, and feeding the mixture of finely ground coal and sponge iron, along with elemental oxygen, to a point below the surface of a molten metal bath within the melter-gasifier.

8 Claims, 1 Drawing Figure

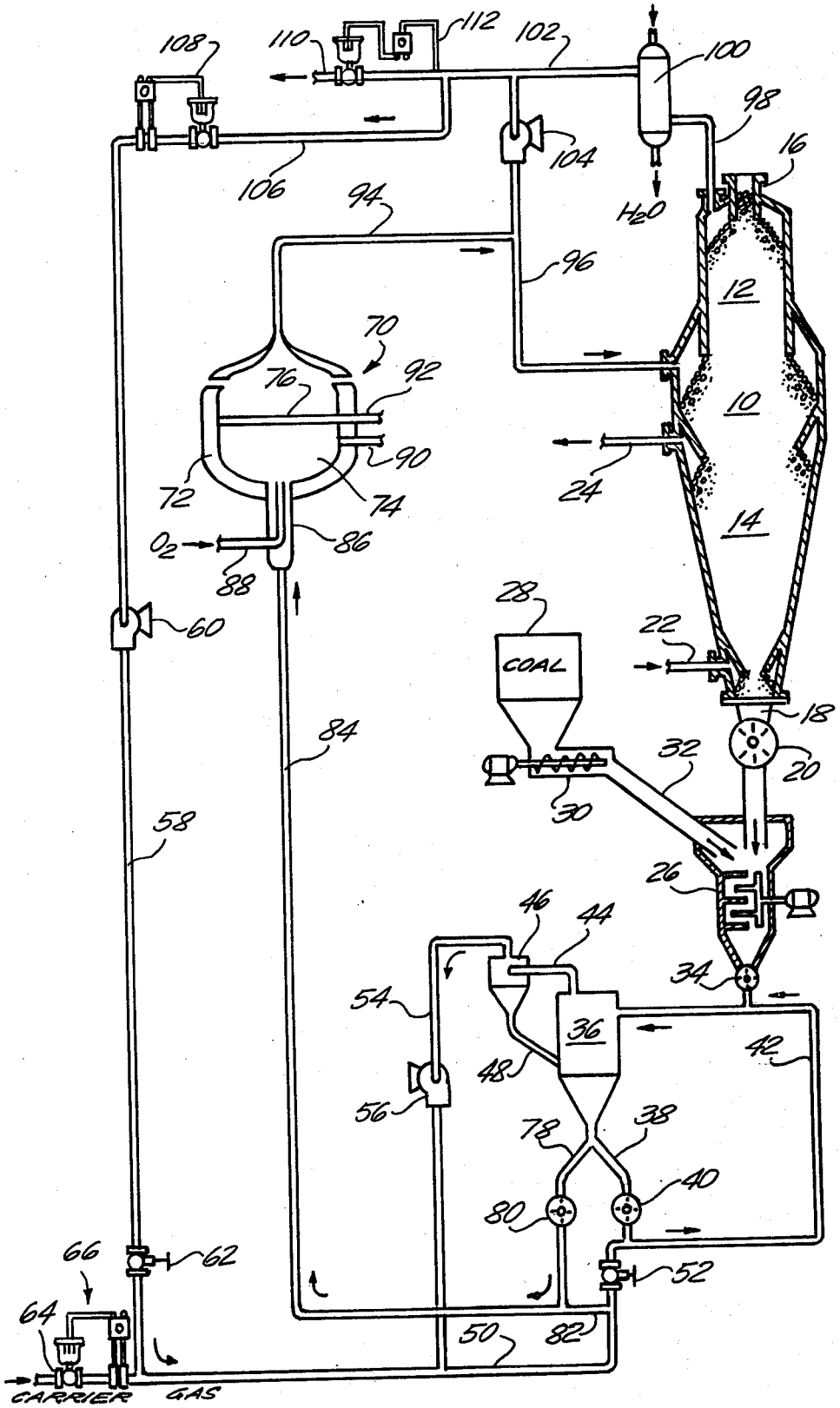
108
110
112
102
100
98
16
104
106
94
$H_2O$
96
12
70
76
92
10
90
72
74
24
14
$O_2$
86
88
60
28
COAL
22
18
84
32
20
30
58
26
46
44
34
54
36
42
48
56
78
38
40
80
66
62
52
64
50
82
CARRIER GAS

METHOD OF CONVERTING IRON ORE INTO MOLTEN IRON

FIELD OF THE INVENTION

This invention relates to a method for producing molten iron from iron ore and more particularly to an improved method of converting the sponge iron pellets produced in known types of moving beds, gaseous reduction reactors to molten iron suitable for steel-making.

BACKGROUND OF THE INVENTION

It has long been known that iron ore in lump or pellet form can be efficiently and economically converted to sponge iron pellets in a vertical shaft, moving bed reactor by passing a hot reducing gas upwardly through a descending bed of the ore particles. It is also known that finely divided ore can be reduced to sponge iron in fine-grained form in a fluid-bed reduction reactor wherein the fine ore particles are suspended in a hot reducing gas. In general these two processes are essentially mutually exclusive since on the one hand the fine-grained ore, if used in a moving bed reactor, creates an excessive gas pressure drop through the bed and on the other hand, ores in lump or pellet form cannot be satisfactorily fluidized in a fluid bed reactor. The moving bed reactor has the important advantage that because it processes a high density mass of the ore it produces a substantially greater tonnage of product per unit volume of reactor than the fluid bed reactor.

It is usually desired to convert the sponge iron produced in such reduction processes to molten form and a number of methods of melting the sponge iron have been proposed. Thus U.S. Pat. Nos. 4,238,226 and 4,248,626 disclose moving bed reactors provided with melter-gasifiers in which a bath of molten iron is maintained. The product sponge iron pellets from the reduction reactor are fed to the top of the molten bath and the bath is maintained molten by feeding a mixture of pulverized coal and oxygen to the gasifier. Reducing gas generated in the gasifier can be used to reduce the ore in the moving bed reactor. Molten iron is intermittently removed from the gasifier for use in steel making. A generally similar system is shown in U.S. Pat. No. 4,007,034.

Processes such as those described above wherein sponge iron pellets from a moving bed reactor are fed to the top of a melter-gasifier are subject to a number of disadvantages due, in large measure, to the fact that the sponge iron contains components that form a layer of slag that floats on the surface of the molten iron bath. Because of its porosity sponge iron has a lower density than the slag and hence has a tendency to accumulate on the top of the slag layer rather than penetrate the slag layer and enter the underlying molten bath. This tendency can be at least partially overcome by providing a relatively long free-fall path for the sponge iron pellets to cause them to acquire sufficient kinetic energy to penetrate the slag layer. However, this necessitates an increase in the gas space above the molten bath and in any case does not insure that all of the sponge iron pellets will penetrate the slag layer.

It should further be noted that the failure of a substantial portion of the sponge iron to quickly penetrate the slag layer results in excessive cooling of the slag with a concomitant build-up of sponge iron both in and on the slag. Such a build-up can result in erratic furnace operation. Moreover, once the porous sponge iron pellets have entered the molten bath, their relatively poor heat conductivity and large particle diameter will retard the desired heat transfer and chemical reaction rates. This will increase the melting and gasification times and consequently the energy consumption due to thermal losses from the melter-gasifier.

It is known that during the reduction process in a vertical shaft, moving bed reactor a certain amount of sponge iron fines are produced by thermal and mechanical degradation of the iron ore. Hence another disadvantage of overhead continuous feeding systems as described above is that part of the fines may not reach the bath but rather may be swept out with the generated gas, thereby reducing the yield of molten iron and overloading the solids collection system through which the generated reducing gas passes after leaving the melter-gasifier. In addition, the presence of sponge iron fines in the upper part of the melter-gasifier can lead to severe chemical attack on and degradation of certain classes of refractory linings used in such equipment.

With respect to the liquefaction of fine sponge iron produced in fluid bed reduction processes, U.S. Pat. No. 4,045,214 describes a process wherein fine-grained iron ores are initially preheated and partially reduced in a counter-current heat exchanger, then reduced in a fluidized bed reactor to form sponge iron. The fine sponge iron is mixed with coal dust and the mixture fed to a molten iron bath in a melter-gasifier to which elemental oxygen is also fed to react with the coal dust and generate a reducing gas that is used as a fluidizing medium in the fluidized bed reactor. As pointed out above, such fluidized bed processes are subject to the disadvantage that because of the expanded character of the fluid bed they produce a relatively small amount of product sponge iron per unit volume of reactor. U.S. Pat. No. 4,008,074 also describes a process wherein fine-grained sponge iron is fed to the molten bath of a melter-gasifier.

SUMMARY OF THE INVENTION

It is accordingly an object of the present invention to provide an improved process for converting iron ore to molten iron. It is another object of the invention to provide an efficient and effective method of so combining a gaseous iron ore reduction reactor and a melter-gasifier as to take advantage of the relatively high production rates attainable with a moving bed reactor while at the same time eliminating the disadvantages of the previously proposed combination systems as outlined above. It is still another object of the invention to provide a combination system of this type having exceptionally good thermal and material efficiencies. Other objects of the invention will in part be implicitly understood as a result of this disclosure and in part be pointed out hereafter.

GENERAL DESCRIPTION

The objects and advantages of the present invention are achieved in general by integrating a moving bed reactor with a melter-gasifier in such a manner that the sponge iron pellets from the moving bed reactor are converted to finely divided form and in admixture with finely divided coal and along with elemental oxygen are fed to the melter-gasifier at a point or points below the upper surface of the molten bath therein. Such an "underfeed" system circumvents the problems encountered when using overhead feed systems of the prior art as described above. The finely divided mixture of sponge iron and coal may, for example, be obtained by separate grinding or milling of the sponge iron pellets and coal with subsequent mixing of the ground materials or alternatively, by pre-mixing the sponge iron and coal and grinding or milling the mixture. Prior to feeding the mixture to the melter-gasifier it is preferably, although not necessarily, homogenized. The use of a finely divided mixture of sponge iron and coal results in rapid melting of the sponge iron and high thermal efficiency in the system.

In this specification and in the accompanying drawing, we have shown and described preferred embodiments of our invention and have suggested various alternatives and modifications thereof; but it is to be understood that these are not intended to be exhaustive and that many other changes and modifications can be made within the scope of the invention. The suggestions herein are selected and included for purposes of illustration in order that others skilled in the art will more fully understand the invention and the principles thereof and will thus be enabled to modify it in a variety of forms, each as may be best suited to the conditions of a particular use.

Referring to the drawing, the numeral 10 generally designates a known and industrially used type of vertically arranged, moving bed, gaseous reduction reactor for reducing iron ore in the form of pellets or lumps to sponge iron. The reactor 10 has a reduction zone 12 in the upper portion thereof and a cooling zone 14 in the lower portion thereof. Pellets of ore to be reduced enter the reactor through an inlet 16 and flow downwardly through the reducing zone 12 wherein they are reduced to sponge iron by an upwardly flowing stream of reducing gas. The sponge iron thus produced then flows through the cooling zone 14 wherein it is cooled by an upwardly flowing stream of cooling gas. The cooled sponge iron leaves the reactor through a discharge conduit 18 containing a rotary vane valve 20 that regulates the flow of material through the reactor. The cooling gas, which may, for example, be the spent reducing gas from the reactor or an inert gas such as nitrogen, is fed to the reactor near the bottom of the zone 14 through pipe 22 and leaves the reactor through pipe 24.

Sponge iron pellets produced in reactor 10 are mixed with coal and the resulting mixture ground to finely divided form. More particularly, the sponge iron pellets are conducted by discharge conduit 18 to the top of a pinned-disc grinder 26. Concurrently, coal from a hopper 28 is fed by a screw conveyor 30 through conduit 32 to the top of the grinder. Discharge of the ground mixture of coal and sponge iron is regulated by a rotary vane valve 34. The mixture is desirably ground to a particle size of 3 mm. or less.

As indicated above, the ground mixture of coal and sponge iron is preferably, although not necessarily, homogenized before being fed to the melter-gasifier. Such homogenization can be effected in a recycling type of homogenizing system as shown in the drawing. The system illustrated comprises a hopper 36, pipe 38 containing rotary valve 40 and return pipe 42 which taken together form a closed loop through which the ground material is circulated by a carrier gas. The ground material passing through valve 34 flows into pipe 42 of the recirculating loop and thence to homogenizing hopper 36 wherein separation of solids from the carrier gas occurs and solids are recycled through pipes 38 and 42. Carrier gas from hopper 36 flows through pipe 44 to a cyclone separator 46 wherein solids are separated therefrom and returned to hopper 36 through pipe 48.

The carrier gas used to convey the finely ground material is supplied to the homogenizing loop through a pipe 50 containing a valve 52 and may be derived from any of several sources. Thus gas separated in the cyclone separator 46 may be recycled through pipe 54 containing pump 56 to pipe 50 and thence to the homogenizing loop. Spent gas from the reactor 10 may be used as the carrier gas and as shown in the drawing may be supplied to pipe 50 through a spent gas supply pipe 58 containing pump 60 and valve 62. Also gas may be supplied from an outside source through pipe 64 containing flow controller 66.

The ground and homogenized mixture of coal and sponge iron is used as the feed material to a melter-gasifier generally designated by the numberal 70. The melter-gasifier may be of a type known and used in the prior art and comprises a refractory-lined vessel 72 containing a bath 74 of molten iron and a layer of slag 76 floating thereon. The coal/sponge iron mixture is withdrawn from the bottom of hopper 36 through pipe 78 containing rotary valve 80 and is conducted by carrier gas supplied from pipe 50 via branch pipe 82 through pipe 84 and inlet 86 to the bottom of the melter-gasifier. Oxygen from a suitable source is supplied to the melter-gasifier through a pipe 88 that extends upwardly through the center of inlet 86. Desirably, both the coal/sponge iron mixture and the oxygen are introduced into the melter-gasifier through tuyeres.

Within the melter-gasifier the coal and oxygen react to provide sufficient heat to maintain the bath 74 molten and to melt the incoming sponge iron particles. However, the oxygen flow is maintained below the amount required to effect complete combustion of the coal. The resulting partial combustion of the coal generates a reducing gas mixture suitable for use in reducing the iron ore fed to reactor 10. The melter-gasifier 70 is provided with a discharge conduit 90 through which molten iron can be withdrawn from the bath 74 and a discharge conduit 92 through which slag can be withdrawn.

Hot reducing gas generated in the melter-gasifier flows through pipes 94 and 96 to the reactor 10. The temperature of the reducing gas as it leaves the surface of the molten bath 74 may be of the order of 1500° C., i.e., substantially higher than is desirable for use in the reduction zone of the reactor. Accordingly, as further described below, the hot gas from the melter-gasifier is mixed with cool spent gas from the reactor in an amount sufficient to produce a mixture having a temperature of the order of 900° C.

The thus blended gas flows through pipe 96 to the lower end of reducing zone 12 and thence upwardly through the bed of ore therein to reduce the ore to sponge iron. Spent reducing gas leaves the top of reactor 10 through pipe 98, flows through a quench cooler 100 to pipe 102, and is then divided into several streams. One portion of the spent gas is recycled by pump 104 and mixed with the fresh reducing gas flowing through pipe 96 to lower its temperature as described above. A second portion of the spent gas flows through pipe 106 containing flow controller 108 to the suction side of pump 60 and thence through pipe 58 to the carrier gas supply pipe 50. The remainder of the spent gas is removed from the system through pipe 110 containing back pressure regulator 112 and flows to a suitable point of use or disposal.

The relative amounts of coal and sponge iron used as feed to the melter-gasifier will vary to some extent depending upon the coal and sponge iron compositions. Typically, the weight ratio of coal to sponge iron will fall between 0.25:1 and 1.2:1. The amount of oxygen used will also vary as a function of the coal and sponge iron composition; the weight ratio of oxygen to sponge iron will usually be in the range 0.35:1 to 0.7:1. If desired, lime can be added to the oxygen stream to react with the sulfur content of the molten bath.

From the foregoing description it should be apparent that the process of the invention provides the several advantages noted at the beginning of the specification. By using a finely ground mixture of coal and sponge iron and introducing the mixture into the bottom of the melter-gasifier with a carrier gas, rapid distribution and melting of the sponge iron particles is achieved, as well as exceptionally effective gas generation. Hence, relatively high thermal and material efficiencies are attained.

We claim:

1. A method for producing molten iron from iron ore which comprises supplying said ore in lump or pellet form to a vertical shaft, moving bed reduction reactor, passing a hot reducing gas upwardly through said moving bed to reduce said ore to sponge iron, establishing a bath of molten iron in a melter-gasifier, preparing a finely ground mixture of coal and said sponge iron, feeding the ground mixture to said molten bath, feeding elemental oxygen to said bath to react with the coal of said mixture to maintain said bath molten and to produce a reducing gas, utilizing at least a part of the reducing gas thus produced as the reducing gas passed through said moving bed of ore and withdrawing molten iron from said melter-gasifier.

2. A method according to claim 1 wherein the coal and sponge iron are mixed before being ground to form the ground mixture fed to said melter-gasifier.

3. A method according to claim 1 wherein the coal and sponge iron are separately ground before being mixed and fed to said melter-gasifier.

4. A method according to claim 1 wherein said finely ground mixture is homogenized before being fed to said melter-gasifier.

5. A method according to claim 1 wherein said finely ground mixture is dispersed in a carrier gas and carried thereby to said melter-gasifier.

6. A method according to claim 5 wherein at least a part of the spent gas from said reduction reactor is used as a carrier gas to carry said ground mixture to said melter-gasifier.

7. A method according to claim 1 wherein said ground mixture is fed to said bath below the upper surface thereof.

8. A method according to claim 7 wherein said ground mixture is fed to the bottom of said bath.

* * * * *